United States Patent [19]

McGarry

[11] Patent Number: 4,632,750

[45] Date of Patent: Dec. 30, 1986

[54] PROCESS FOR COAL BENEFICIATION BY FROTH FLOTATION EMPLOYING PRETREATED WATER

[75] Inventor: Phillip E. McGarry, Palmerton, Pa.

[73] Assignee: The Standard Oil Company, Cleveland, Ohio

[21] Appl. No.: 778,327

[22] Filed: Sep. 20, 1985

[51] Int. Cl.[4] ..... B03D 1/14

[52] U.S. Cl. ..... 209/166

[58] Field of Search ..... 209/166; 252/61; 44/1 R, 15 R; 210/698, 732

[56] References Cited

U.S. PATENT DOCUMENTS

| | | | |
|---|---|---|---|
| 2,696,431 | 12/1954 | Kidd . | |
| 3,203,968 | 8/1955 | Sebba . | |
| 4,054,516 | 10/1977 | Izumi et al. . | |
| 4,304,573 | 12/1981 | Burgess et al. . | |
| 4,377,472 | 3/1983 | Allen | 209/166 |
| 4,406,664 | 9/1983 | Burgess et al. | 209/166 |
| 4,460,460 | 7/1984 | Caviello et al. | 209/167 |

FOREIGN PATENT DOCUMENTS

| | | | |
|---|---|---|---|
| 0106787 | 4/1984 | European Pat. Off. | 252/61 |

*Primary Examiner*—Bernard Nozick

*Attorney, Agent, or Firm*—Bruce E. Harang; David J. Untener; Larry W. Evans

[57] ABSTRACT

A process for the beneficiation of coal by froth flotation comprising surface treating particulate coal with a polymerizable monomer, a polymerization catalyst and a liquid organic carrier thereby rendering said particulate coal hydrophobic and oleophilic and introducing said surface treated particulate coal to a froth flotation vessel containing a water wash medium thereby resulting in a froth phase and an aqueous phase, the improvement comprising pre-treating said water wash medium prior to introducing said surface treated particulate coal with an organic carboxylic acid.

8 Claims, No Drawings

PROCESS FOR COAL BENEFICIATION BY FROTH FLOTATION EMPLOYING PRETREATED WATER

BACKGROUND OF THE INVENTION

This invention relates to the beneficiation of mineral values by froth flotation and more particularly to the beneficiation of coal by froth flotation.

Many valuable minerals, such as coal, are beneficiated by froth flotation. Coal is an extremely valuable natural resource in the United States because of its relatively abundant supply. Energy shortages together with the availability of abundant coal reserves has created a new interest in the use of coal as an alternate or primary energy source. As a result, great efforts are being taken to make coal and related solid carbonaceous materials equivalent or better sources of energy than petroleum or natural gas. In this context, numerous techniques have been and are being explored to make coal cleaner burning, more suitable for burning and more readily transportable.

Coal must be cleaned because it contains substantial amounts of sulfur, nitrogen compounds and mineral matter, including significant quantities of metal impurities. During combustion these materials enter the environment as sulfur dioxides, nitrogen oxides and compounds of metal impurities. If coal is to be accepted as a primary or alternate energy source, it must be cleaned to prevent pollution of the environment.

Accordingly, physical, as well as chemical, coal cleaning (beneficiation) processes have been extensively explored. In general, physical coal cleaning processes involve grinding the coal to release the impurities, wherein the fineness of the coal generally governs the degree to which the impurities are released. However, because the costs of preparing the coal rise exponentially with the amount of fines, there is an economic optimum in size reduction. Moreover, grinding coal even to the finest sizes is not effective in removing all impurities.

Based on the physical properties that effect the separation of the coal from the impurities, physical coal cleaning methods are divided into four general categories: gravity, flotation, magnetic and electrical methods.

Chemical coal cleaning techniques are in a very early stage of development. Known chemical coal cleaning techniques include, for example, oxidative desulfurization of coal (sulfur is converted to a water-soluble form by air oxidation), ferric salt leaching (oxidation of pyritic sulfur with ferric sulfate), and hydrogen peroxide-sulfuric acid leaching.

A recent promising development in the art of chemical coal beneficiation is disclosed in U.S. Pat. No. 4,304,573 incorporated herein by reference. In summary, according to this chemical coal beneficiation froth flotation process, coal is first cleaned of rock and the like and pulverized to a fine size. The pulverized coal, now in the form of a water slurry, is then contacted with a mixture comprising a polymerizable monomer, polymerization catalyst and fuel oil. The resultant surface treated coal is highly hydrophobic and oleophilic and is thus readily separated from unwanted ash and sulfur using oil and water flotation separation techniques.

In this flotation process and in others which employ anionic collectors, the presence of large amounts of cations, however, in the process water is deleterious to overall efficiency of the process. Even in flotation processes, such as coal flotation processes, which do not utilize these collectors, the presence of these cations increases the ash content and lowers the fusion temperature of the ash which results in undesirable increased slag and caking when the coal is burned.

It is desirable therefore to provide a flotation process which avoids these disadvantages and furthermore results in cleaner and enhanced mineral, e.g. coal, recoveries.

SUMMARY OF THE INVENTION

Accordingly, it is one object of the present invention to provide a novel and improved process for the beneficiation of mineral values by froth flotation.

Another object of this invention is to provide an improved froth flotation process for the beneficiation of solid carbonaceous matter, particularly coal.

A further object of the present invention is to provide a froth flotation coal beneficiation process which avoids the deleterious effects associated with the presence of undesirable cations in the process water.

A still further object of this invention is to provide a froth flotation coal beneficiation process which results in a coal product having reduced ash and improved ash fusion temperature.

These and other objects are accomplished herein by a process for the beneficiation of solid carbonaceous matter by froth flotation comprising surface treating solid carbonaceous particles with a polymerizable monomer, a polymerization catalyst and a liquid organic carrier thereby rendering said solid carbonaceous particles hydrophobic and oleophilic and introducing said surface treated solid carbonaceous particles to a froth flotation zone containing a water wash medium thereby resulting in a froth phase and an aqueous phase, the improvement comprising pre-treating said water wash medium prior to introducing said surface treated solid carbonaceous particles with an organic carboxylic acid or salt thereof.

DETAILED DESCRIPTION OF THE INVENTION

In accordance with the present invention, the beneficiation of solid carbonaceous matter, such as coal, by froth flotation is improved by pre-conditioning the wash water to be used in the flotation process with an organic monocarboxylic acid to remove cations which are present in the water which act to reduce the overall efficiency of the flotation process. The organic carboxylic acid or salt thereof is mixed with the water to be treated under agitation. The insoluble salts which are formed and precipitated are then separated from the water by suitable means, such as by filtration, and the water is now ready to be used in the flotation beneficiation process.

Suitable organic carboxylic acids useful in the improvement of the present process typically have the general formula $$R(\overset{\overset{\displaystyle O}{\|}}{C}-OR^1)_n$$

wherein $R^1$ is H or alkali metal or ammonium, R is an organic radical having at least about 6 carbon atoms and generally having from about 6 to about 25 carbon atoms and n is an integer of at least 1, preferably from 1 to about 10. More particularly, R can be a saturated or olefinically unsaturated, such as an ethylenically unsaturated, hydrocarbyl radical. Preferably, R contains from about 6 to about 25 carbon atoms. Specific organic carboxylic acids encompassed by the foregoing formula include, malonic acid, adipic acid, pimelic acid, suberic acid, oleic acid, palmitic acid, stearic acid, tall oil, lauric acid, myristic acid, behenic acid, linoleic acid, linolenic acid, ricinoleic acid, butanetetracarboxylic acid, pentanetetracarboxylic acid, caproic acid, azelaic acid, pelargonic acid, humic acid, and the like. High molecular weight mono or dicarboxylic acids are most preferred.

Thus, any organic carboxylic acid capable of forming an insoluble salt with the deleterious cations present in the flotation wash water is suitable for the hereindescribed purposes. The amount of organic carboxylic acid utilized in the process of the present invention will vary on the quantity of cations present in the flotation wash water which are to be removed. The amount of acid utilized is readily determined by the stoichiometry of the chemical reaction which occurs. For example, in the case of a monocarboxylic acid and monovalent or divalent cations, the amount of acid employed is readily determined by the stoichiometry of the following chemical reactions:

$$RC(=O)-OH + M^{+} \longrightarrow R-C(=O)-OM + H^{+}$$

$$2RC(=O)-OH + M^{++} \longrightarrow R(C(=O)-O)_2M + 2H^{+}$$

Generally, it is preferred to employ from about 10% to about 50% excess of the stoichiometric amount of the organic carboxylic acid to insure complete removal of deleterious cation. Typical deleterious cations which are intended to be removed by the improved process of the present invention include, for example, alkaline earth metals, such as calcium, magnesium, and heavy metals, such as iron, lead, aluminum, and the like which will form water insoluble solids when contacted and reacted with the organic carboxylic acids utilized herein.

In carrying out the beneficiation process of the present invention, carbonaceous solid matter, such as coal, is beneficiated by froth flotation techniques. A preferred froth flotation beneficiation technique, which when employed and integrated with the water pretreatment process of the present invention, results in especially improved recoveries and improved impurities removal, is the beneficiation process disclosed in U.S. Pat. No. 4,304,573 (Burgess et al), the entire contents of which are incorporated herein by reference.

Thus, in accordance with one froth flotation process which may be utilized herein, wherein raw mined coal is employed as the feedstock, it is initially preferred to reduce the raw mined coal (or other solid carbonaceous matter) to a fine diameter size and to remove unwanted rock, heavy ash and the like materials collected in the mining operation. Thus, the coal is pulverized and initially cleaned, usually in the presence of water, wherein the coal is suspended and/or sufficiently wetted to permit fluid flow. In conformance with the specific improvement herein, the water in which the coal is suspended and/or wetted is preferably pre-treated with the hereinbefore-described organic carboxylic acids to substantially remove deleterious cations which may be present in the water. The coal is pulverized employing conventional equipment such as, for example, ball or rod mills, breakers and the like.

The coal-aqueous slurry formed in the pulverization operation is typically one having a coal to water ratio of from about 0.5:1 to about 1:20 and preferably about 1:7 parts by weight, respectfully. While it is generally recognized that more impurities are liberated as the size of the coal is reduced, the law of diminishing returns applies in that there is an economic optimum which governs the degree of pulverization. In any event, for the purposes of this invention, it is generally desirable to crush the coal to a particle size of from about 48 to about less than 325 mesh, preferably about 80% of the particles being of about a 200 mesh size (Tyler Standard Screen Size).

Any type coal can be beneficiated in the process of the present invention. Typically, these include, for example, bituminous coal, sub-bituminous coal, anthracite, lignite and the like. Other solid carbonaceous fuel materials, such as oil shale, tar sands, coke, graphite, mine tailings, coal from refuse piles, coal processing fines, coal fines from mine ponds or tailings, carbonaceous fecal matter and the like are also contemplated for treatment by the process herein. Thus, for the purposes of this invention, the term "coal" is intended to include these kinds of other solid carbonaceous fuel materials or streams.

In carrying out the preferred beneficiation process herein, the coal-aqueous slurry, containing the pulverized coal, is contacted and admixed with a surface treating mixture comprised of a polymerizable monomer, polymerization catalyst and a small amount of a liquid organic carrier, such as fuel oil.

Any polymerizable monomer can be employed in the surface treating polymerization reaction medium. While it is more convenient to utilize monomers which are liquid at ambient temperature and pressure, gaseous monomers which contain olefinic unsaturation permitting polymerization with the same or different molecules can also be used. Thus, monomers intended to be employed herein may be characterized by the formula XHC=CHX' wherein X and X' each may be hydrogen or any of a wide variety of organic radicals or inorganic substituents. Illustratively, such monomers include ethylene, propylene, butylene, tetrapropylene, isoprene, butadiene, such as 1,4-butadiene, pentadiene, dicyclopentadiene, octadiene, olefinic petroleum fractions, styrene, vinyltoluene, vinylchloride, acrylonitrile, methacrylonitrile, acrylamide, methacrylamide N-methylolacrylamide, acrolein, maleic acid, maleic anhydride, fumaric acid, abietic acid and the like.

A preferred class of monomers are unsaturated carboxylic acids, esters, anhydrides or salts thereof, particularly those included within the formula $$RC(=O)-OR'$$

wherein R is an olefinically unsaturated organic radical, preferably containing from about 2 to about 30 carbon atoms, and R' is hydrogen, a salt-forming cation such as alkali metal, alkaline earth metal or ammonium cation, or a saturated or ethylenically unsaturated hydrocarbyl radical, preferably containing from 1 to about 30 carbon atoms, either unsubstituted or substituted with one or more halogen atoms, carboxylic acid groups and/or hydroxyl groups in which the hydroxyl hydrogens may be replaced with saturated and/or unsaturated acyl groups, the latter preferably containing from about 8 to about 30 carbon atoms. Specific monomers conforming to the foregoing structural formula include unsaturated fatty acids such as oleic acid, linoleic acid, linolenic, ricinoleic, mono-, di- and tri-glycerides, and other esters of unsaturated fatty acids, acrylic acid, methacrylic acid, methylacrylate, ethylacrylate, ethylhexylacrylate, tertiarybutylacrylate, oleylacrylate, methylmethacrylate, oleylmethacrylate, stearylacrylate, stearylmethacrylate, laurylmethacrylate, vinylacetate, vinylstearate, vinylmyristate, vinyllaurate, unsaturated vegetable seed oil, soybean oil, rosin acids, dehydrated castor oil, linseed oil, olive oil, peanut oil, tall oil, corn oil and the like. For the purposes of this invention, tall oil and corn oil have been found to provide particularly advantageous results. Moreover, it is to be clearly understood that compositions containing compounds within the foregoing formula and in addition containing, for example, saturated fatty acids such as palmitic, stearic, etc. are also contemplated herein. Also contemplated herein as monomers are aliphatic and/or polymeric petroleum materials.

The amount of polymerizable monomer will vary depending upon the degree of surface treatment desired. In general, however, monomer amounts of from about 0.005 to about 0.1%, by weight, of the dry coal are used.

The catalysts employed in the coal surface treating beneficiation reaction of the present invention are any such materials commonly used in polymerization reactions. These include, for example, anionic, cationic or free radical catalysts. Free radical catalysts or catalyst systems (also referred to as addition polymerization catalysts, vinyl polymerization catalysts, vinyl polymerization catalysts or polymerization initiators) are preferred herein. Thus, illustratively, free radical catalysts contemplated herein include, for example, inorganic and organic peroxides such as benzoyl peroxide, methylethyl ketone peroxide, tert-butylhydroperoxide, hydrogen peroxide, ammonium persulfate, di-tertbutylperoxide, tert-butyl-perbenzoate, peracetic acid and including such non-peroxy free-radical initiators as the diazo compounds such as 1,1'-bisazoisobutyronitrile and the like.

Typically, for the purposes of this invention, any catalytic amounts (e.g. 1 pound per ton of dry coal feed) of the foregoing described catalysts can be used.

Moreover, free radical polymerization systems commonly employ free radical initiators which function to help initiate the free radical reaction. For the purposes herein, any of those disclosed in the prior art, such as those disclosed, for example, in U.S. Pat. No. 4,033,852, incorporated by reference herein, may be used. Specifically, some of these initiators include, for example, water soluble salts, such as sodium perchlorate and perborate, sodium persulfate, potassium persulfate, ammonium persulfate, silver nitrate, water soluble salts of noble metals such as platinum and gold, sulfites, nitrites and other compounds containing the like oxidizing anions, and water soluble salts of iron, nickel chromium, copper, mercury, aluminum, cobalt, manganese, zinc, arsenic, antimony, tin, cadmium, and the like. Particularly preferred initiators herein are the water soluble copper salts, i.e. cuprous and cupric salts, such as copper acetate, copper sulfate and copper nitrate. Most advantageous results have been obtained herein with cupric nitrate, $Cu(NO_3)_2$ . Further initiators contemplated herein are disclosed in copending U.S. patent application Ser. No. 230,063 filed Jan. 29, 1981 incorporated herein by reference. Among others, these initiators include metal salts of organic moities, typically metal salts of organic acids or compositions containing organic acids, such as naphthenates, tallates, octanoates, etc. and other organic soluble metal salts, said metals including copper, chromium, mercury, aluminum, antimony, arsenic, cobalt, manganese, nickel, tin, lead, zinc, rare earths, mixed rare earths, and mixtures thereof and double salts of such metals. The combination of copper and cobalt salts, particularly cupric nitrate and cobalt naphthenate, have been found to provide particularly good and synergistic results.

The amount of free radical initiator contemplated herein may be any catalytically effective amount and generally is within the range of from about 10–1000 ppm (parts per million) of the metal portion of the initiator, preferably 10–200 ppm, based on the amount of dry coal.

The surface treating reaction mixture of the present invention also includes a liquid organic carrier. This liquid organic carrier is utilized to facilitate contact of the surface of the coal particles with the polymerization reaction medium. Thus, liquid organic carriers included within the scope of this invention are, for example, fuel oil, such as No. 2 or No. 6 fuel oils, other hydrocarbons including benzene, toluene, xylene, hydrocarbons fractions, such as naphtha and medium boiling petroleum fractions (boiling point 100°–180° C.); dimethylformamide, tetrahydrofuran, tetrahydrofurfuryl alcohol, dimethylsulfoxide, methanol, ethanol, isopropyl alcohol, acetone, methylethyl ketone, ethyl acetate and the like and mixtures thereof. For the purposes of this invention, fuel oil is a preferred carrier.

The amounts of liquid organic carrier, such as fuel oil, utilized in the surface treatment reaction herein are generally in the range of from about 0.25 to about 5% by weight, based on the weight of dry coal.

The surface treatment reaction of the present process is carried out in an aqueous medium. The amount of water employed for this purpose is generally from about 5% to about 95%, by weight, based on the weight of coal slurry.

In the practice of the present invention, the coal can be contacted with the surface treating ingredients by employing various techniques. For example, one technique is to feed the aqueous pulverized coal slurry through a spraying means, e.g. nozzle, and add the surface treating ingredients, i.e. polymerizable monomer, polymerization catalyst, initiator and liquid organic carrier to the aqueous coal spray. The resultant total spray mixture is then introduced to an aqueous medium contained in a beneficiation vessel for froth flotation. As described hereinbefore, the aqueous medium in the flotation vessel has been pre-treated with organic carboxylic acid to remove deleterious cations.

In a second technique, the aqueous coal slurry and surface treating ingredients, i.e. polymerizable monomer, polymerization catalyst, initiator and liquid organic carrier, are admixed in a premix tank and the resultant admixture is sprayed, e.g. through a nozzle, into an aqueous medium (pre-treated with a carboxylic acid as before) contained in a beneficiation vessel for froth flotation.

As the surface treating reaction is completed, the hydrophobic and oleophilic beneficiated coal particles float to the surface of the liquid mass. The ash, still remaining hydrophilic, tends to settle and is removed to the water phase. Thus, the coal which results from reaction with the hereinbefore described polymerizable surface treating mixture is extremely hydrophobic and oleophilic and consequently readily floats and separates from the aqueous phase, providing a ready water washing and for high recoveries of coal. The floating hydrophobic coal is also readily separable from the aqueous phase (for example, a skimming screen may be used for the separation), which contains ash, sulfur and other impurities which have been removed from the coal.

In the practice of the present invention, the surface treated coal is preferably subjected to at least one further wash step wherein the coal phase or phases are re-dispersed, with good agitation, e.g. employing high speed mixers, as a slurry in fresh wash water. Preferably, the initially surface treated coal is added to the wash water under atomizing pressure through a spray nozzle thus forming minute droplets in air which are directed with force onto and into the surface of the fresh water mass. The water utilized herein again in this additional wash step and any subsequent wash steps has preferably been pre-treated with organic carboxylic acid to remove deleterious cations.

By spraying, the wash water and the coal phase are intimately admixed under high speed agitation and/or shear produced by the spray nozzle under super atmospheric pressures. In this manner, the hydrophobic coal particles are jetted into intimate contact with the wash water through one or more orifices of the spray nozzle thereby inducing air inclusion, both in the passage through the nozzle as well as upon impingement upon and into the air-water interface of the wash water bath.

U.S. Pat. Nos. 4,347,126 and 4,347,127 both incorporated by reference herein, describe and claim a particularly effective method and apparatus for separating the treated coal particles from unwanted ash and sulfur in the water phase utilizing an aeration spray technique, wherein a coal froth phase is formed by spraying or injecting the treated coal-water slurry into the surface of the cleaning water. Briefly, according to the method and apparatus there described, the coal slurry is injected through at least one selected spray nozzle, preferably of the hollow cone type, at pressures, for example, at from about 15–20 psig, at a spaced-apart distance above the water surface, into the water surface producing aeration and a frothing or foaming of the coal particles, causing these particles to float to the water surface for skimming off.

The foregoing described washings may be carried out with the treated coal slurry in the presence of simply water at temperatures of, for example, about 10° to about 90° C., preferably about 30° C., employing from about 99 to about 65 weight percent water, based on the weight of dry coal feed. Alternatively, additional amounts of any or all of the heretofore described surface treating ingredients i.e. polymerizable monomer, catalyst, initiator, liquid organic carrier, may also be added to the wash water. Moreover, the washing conditions e.g. temperature, contact time, etc., utilized when these ingredients are employed can be the same as if only water is present or the washing conditions can be the same as those described heretofore with respect to surface treatment of the coal with the surface treating mixture.

After washing and/or additional surface treatment, the beneficiated coal may be dried to low water levels simply by mechanical means, such as by centrifugation, pressure or vacuum filtration etc., thus avoiding the necessity for costly thermal energy to remove residual water.

In order that those skilled in the art may better understand how the present invention may be practiced, the following examples are given by way of illustration and not by way of limitation.

EXAMPLE 1

A coal froth flotation wash water bath (500 mls. water) is determined to contain 400 ppm $Ca^{+2}$ ion. 5.23 gms. ammonium oleate (derived from tall oil containing about 80% oleic acid) is added to the $Ca^{+2}$ ion containing water bath. Within a few seconds, a white insoluble solid forms throughout the bath and rises to the surface. The solid is filtered using a Buchner funnel and No. 1 Whatman filter paper.

The filtrate is titrated using the ASTM 311C EDTA titrimetric method and determined to contain 28 ppm $Ca^{+2}$ ion, a reduction of 93% from the initial bath.

Particulate coal is froth floated and beneficiated in the above pre-treated wash water in accordance with the teachings of U.S. Pat. No. 4,304,573. The resultant particulate coal product has reduced ash and improved ash fusion temperature.

EXAMPLE 2

A coal froth flotation wash water bath is determined to contain 0.399 g. $Ca^{+2}$ ion/liter. A 10% excess of the stoichiometric amount of ammonium oleate (derived from oleic acid) is added to the $Ca^{+2}$ ion containing water bath. Within a few seconds, a white insoluble solid forms throughout the bath. The solid is filtered using a Buchner funnel and No. 1 Whatman filter paper.

The filtrate is titrated using the ASTM 311C EDTA titrimetric method and determined to contain 0.0721 g. $Ca^{+2}$ ion/liter, a reduction of about 82% from the initial bath.

Particulate coal is froth floated and beneficiated in the above pre-treated wash water in accordance with the teachings of U.S. Pat. No. 4,304,573. The resultant particulate coal product has reduced ash and improved ash fusion temperature.

I claim:

1. In a process for the beneficiation of coal by froth flotation comprising surface treating particulate coal with a polymerizable monomer, a polymerization catalyst and a liquid organic carrier thereby rendering said particulate coal hydrophobic and oleophilic and introducing said surface treated particulate coal to a froth flotation vessel containing a water wash medium thereby resulting in a froth phase and an aqueous phase, the improvement comprising pre-treating said water wash medium prior to introducing said surface treated particulate coal with an organic carboxylic acid or alkalai metal or ammonium salt thereof.

2. The process of claim 1 wherein said organic carboxylic acid is a monocarboxylic acid or a discarboxylic acid or salt thereof.

3. The process of claim 1 wherein the organic carboxylic acid or salt thereof is employed in the water wash medium in an amount from about 10% excess to about 50% excess of the stoichiometric amount necessary to remove the undesired cations.

4. The process of claim 1 wherein said organic carboxylic acid or salt thereof has the general formula:

$$R(\overset{\overset{\displaystyle O}{\|}}{C}-OR')_n$$

wherein R is an organic radical having at least 6 carbon atoms, n is an integer of at least 1 and R′ is selected from the group consisting of hydrogen, alkali metal and ammonium.

5. The process of claim 4 wherein R is a saturated or ethylenically unsaturated hydrocarbyl radical having from about 6 to about 25 carbon atoms.

6. The process of claim 4 wherein said organic carboxylic acid or salt thereof is selected from the group consisting of oleic acid, palmitic acid, stearic acid, tall oil, linoleic acid, linolenic acid, ricinoleic acid and humic acid or the alkali metal or ammonium salts thereof.

7. The process of claim 6 wherein said organic carboxylic acid is tall oil or oleic acid.

8. The process of claim 7 wherein said organic carboxylic acid salt is ammonium oleate or the ammonium salt of tall oil.

* * * * *